US008096625B2

(12) United States Patent
Willis

(10) Patent No.: US 8,096,625 B2
(45) Date of Patent: Jan. 17, 2012

(54) PROJECT MANAGEMENT DESK

(76) Inventor: Michael G. Willis, Colorado Springs, CO (US)

( * ) Notice: Subject to any disclaimer, the term of this patent is extended or adjusted under 35 U.S.C. 154(b) by 862 days.

(21) Appl. No.: 12/123,313

(22) Filed: May 19, 2008

(65) Prior Publication Data

US 2009/0284107 A1 Nov. 19, 2009

(51) Int. Cl.
*A47B 3/00* (2006.01)

(52) U.S. Cl. ..... 312/122; 312/126; 312/348.3; 312/194

(58) Field of Classification Search ..... 312/348.3, 312/348.5, 119, 122, 126–127, 194–196; 108/25–26, 43
See application file for complete search history.

(56) References Cited

U.S. PATENT DOCUMENTS 957,461 A * 5/1910 Forchheimer ..... 312/122
968,719 A * 8/1910 Warsop ..... 312/119
1,137,073 A * 4/1915 Morris ..... 312/122
1,653,530 A * 12/1927 Abrachinsky ..... 312/286
1,663,337 A * 3/1928 Eustis ..... 312/122
1,672,633 A * 6/1928 Vogel ..... 211/55
D247,205 S * 2/1978 Mabugat ..... D6/406.6
4,927,214 A * 5/1990 Kaufman et al. ..... 312/195
5,218,912 A * 6/1993 Buske ..... 108/26
5,603,558 A * 2/1997 Zimmer ..... 312/290
5,678,907 A * 10/1997 Schainholz ..... 312/223.6
5,782,185 A * 7/1998 Frahm et al. ..... 100/25
5,915,804 A * 6/1999 Crescenzo ..... 312/325
5,979,337 A * 11/1999 Clark et al. ..... 108/43
6,170,926 B1 1/2001 Roberts et al.
6,715,849 B2 * 4/2004 Fink ..... 312/122
2002/0084726 A1 * 7/2002 O'Neill et al. ..... 312/122

* cited by examiner

*Primary Examiner* — Hanh V Tran
(74) *Attorney, Agent, or Firm* — Richard W. Hanes; Hanes Hrbacek & Bartels LLC

(57) ABSTRACT

A project management desk having a transparent working surface supported by spaced apart legs and below which is disposed a sliding tray having a plurality of side by side document compartments, the contents of which are visible through the working surface.

2 Claims, 4 Drawing Sheets

PROJECT MANAGEMENT DESK

FIELD OF THE INVENTION

The present invention relates to a work desk and more particularly to a desk having viewable compartments for holding documents related to a single work project or documents related to separate tasks comprising one work project.

BACKGROUND OF THE INVENTION

Work desks and benches have been employed for centuries but, except for esthetic variations, the structure and composition of work desks has remained constant. Working desks range from simple table tops to a working surface having elevated storage compartments, such as the old roll top desk, to the modern office desk having a top working surface and subordinate storage drawers. Whether the means for storing documents and things related to a particular work project take the form of compartments that are disposed over the desk working surface, below the working surface or in drawers, the problem remains the same. That is, once papers or things are placed in a slot, drawer or receptacle they are substantially out of sight and out of mind.

It is therefore the primary object of the present invention to provide a work desk having project paper compartments in which at least one of each of the project or task documents, such a summary or status report, can easily be seen by one working or standing at the desk without having to remove the papers or things from the compartment in which they are positioned.

Another object of the invention is to create a series of document compartments in a working desk where the compartments are visually related to project priority.

A further object of the invention is to provide a method of managing a plurality of work projects using a customized desk.

Other objects, features and advantages of the project management desk of the present invention will become obvious upon a reading of the following detailed description of the invention taken in conjunction with the attached drawings.

SUMMARY OF THE INVENTION

The desk of the present invention comprises a plurality of legs which support a transparent working surface that covers a plurality of side by side document storing compartments that each has a bottom and partitioning side members. In operation, documents related to a single work project are organized into respective stacks. The separate stacks are distributed to respective selected ones of the side by side compartments so that each compartment beneath the transparent working surface represents a single project or matter. To be most useful, the status, a summary or other indication of necessary action of each project or task is clearly indicated on the top document in the compartment. With a clean desk top, the status, priority or next action on the various projects stored below the transparent desk top can be seen and a particular project can be selected for attention.

DETAILED DESCRIPTION OF PREFERRED EMBODIMENT

Figure 1:
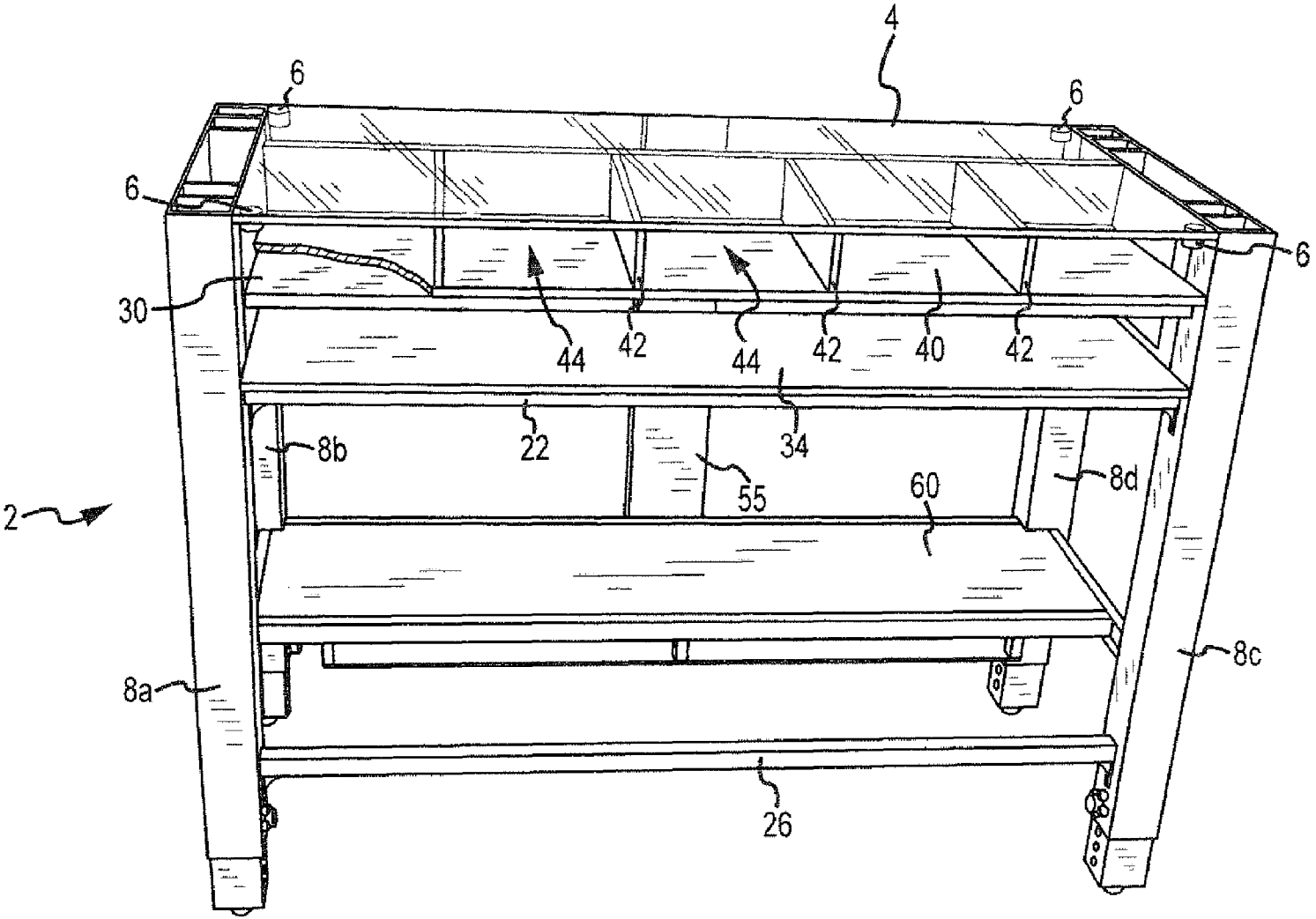
FIG. 1 is a frontal perspective view of the desk of the present invention.
Figure 2:
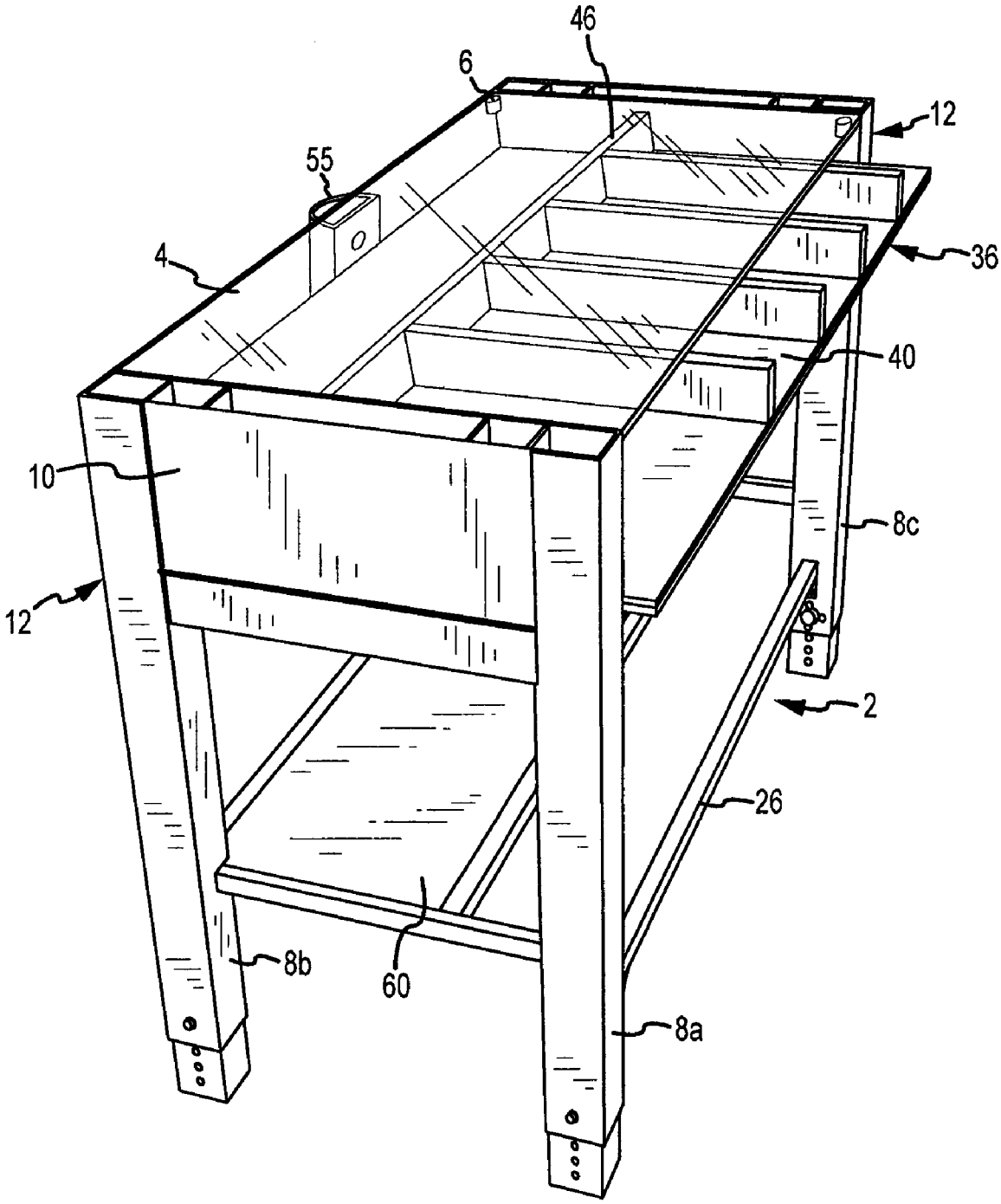
FIG. 2 is a side perspective view of the desk showing the compartment tray partially pulled out.
Figure 3:
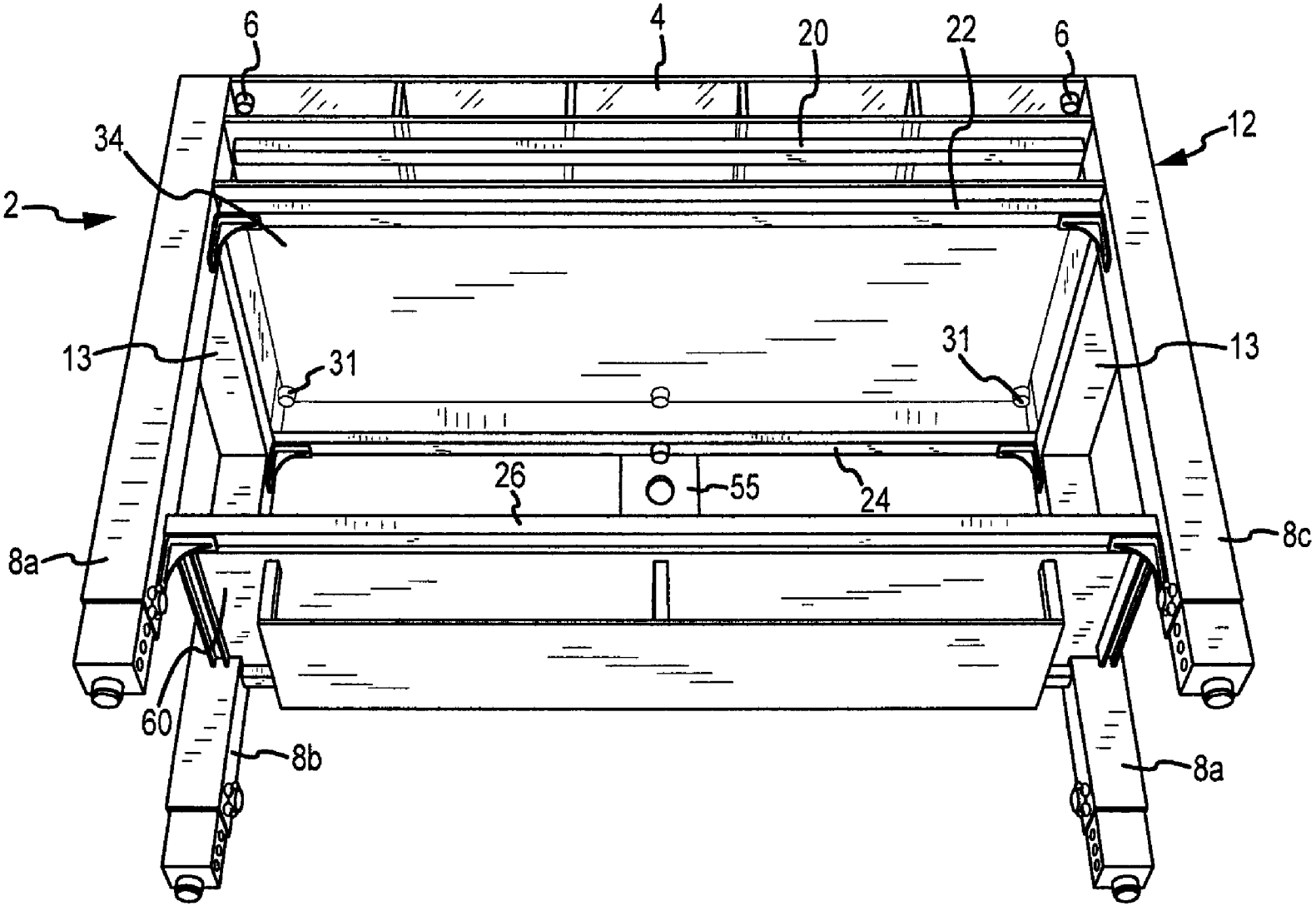
FIG. 3 is a bottom perspective view of the desk.
Figure 4:
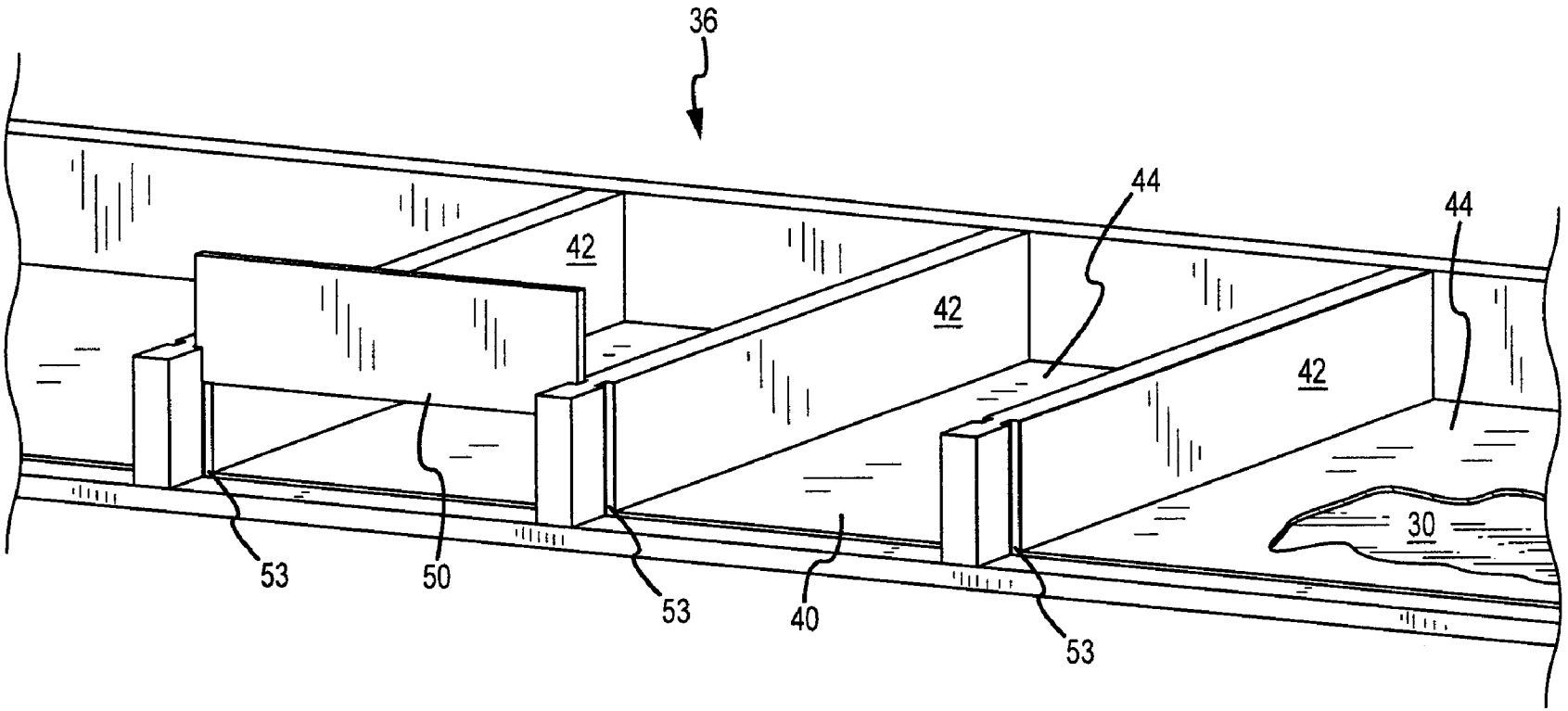
FIG. 4 is a fragmentary perspective view of the compartment tray showing an optional door on one compartment.

A preferred embodiment of the desk 2 of the present invention is shown in FIGS. 1 through 4 of the drawings. A rectangular transparent glass working surface 4 is supported at each of its corners by pads 6 that are attached to the respective upper ends of four legs 8*a*, 8*b*, 8*c* and 8*d*. The two legs at each end of the surface glass 4 are interconnected by a double sided panel 10 forming a unitary end support 12. Each of the end support panels 10 contains a bottom portion 13 and an open top, providing storage space for pencils or other desk related implements.

The end supports 12 are structurally interconnected by rigid struts 20, 22, 24 and 26. A front strut 20 is located near the top of the legs 8 and interconnects legs 8*a* and 8*c* and supports the front edge of the compartment tray shelf 30. The back edge of shelf 30 is supported by pads 31 attached to legs 8*b* and 8*d*.

Strut 22 interconnects legs 8*a* and 8*c* and functions to support the front edge of a middle shelf 34. Strut 24 interconnects legs 8*b* and 8*d* and supports the rear edge of the middle shelf. Strut 26 interconnects the lower portion of the front legs 8*a* and 8*c* and acts as a foot rest for persons standing at the desk 2.

A compartment tray 36 includes a flat floor forming bottom 40 and a plurality of spaced apart partitions 42 that define the side walls of document containing compartments 44. A rear wall 46 spans all of the compartments and is mounted on the flat bottom member 40. Optionally, one or more of the compartments 44 may be equipped with a front closure 50 that may slide up and down in opposing side wall channels 53. The closures may be equipped with conventional locking mechanisms if desired. In order to open or close the closures 50, the tray 36 is pulled out of its normal resting position on the tray shelf 30 a sufficient distance so that the closure is clear of the front edge of the overlying surface glass 4.

A lower shelf unit 60 interconnects the end supports 12 to provide lower shelf space for managing cables of computer components that may be placed on the surface glass 4 or the middle shelf 34. Preferably, a vertically disposed cable management tube 55 is attached to the back edges of the shelves for routing of electrical component cables from the top portion of the desk to the lower shelf unit 60 or to the floor beneath the desk 2.

The desk of the present invention is an important complement to the implementation of the novel project management method of the present invention that enables a worker at the desk to visualize a number of priority projects on which he or she is working so as to be able to select the project that deserves first, second or third priority attention and having the relevant file documents ready for immediate use at the desk. In its basic form the management method includes the following steps. All documents related to a single work project are organized into respective groups. The separate groups, or stacks of documents or things, are distributed to respective selected ones of the side by side compartments so that each compartment beneath the transparent working surface represents a single project or matter. The status of each project is clearly indicated on the top document in the compartment so that it can be seen through the transparent working surface. With a clean desk top, the status or priority of the various projects stored below the transparent desk top can be seen and a particular project can be selected for attention.

In addition to a desk worker being able to quickly assess the projects and their respective priorities, it is easy for a manager to evaluate the progress of certain projects just by viewing the project status sheets through the transparent working surface 4.

What is claimed is:

1. A project management desk comprising, a plurality of vertically oriented spaced apart supports defining a width, each of the supports including a pair of spaced apart legs, each leg having an upper end and a lower end, and a hollow panel member interconnecting the upper ends of the legs, wherein the panel member is open at the top for storing writing utensils or other office equipment, a single horizontally oriented tray having a front and rear perimeter edge slidably mounted between the spaced apart supports, said tray having a width substantially the same as the width defined by said spaced apart supports and comprising a flat floor member and a plurality of vertically oriented spaced apart planar mutually parallel partitions that define a plurality of compartments, and a transparent working surface carried by bracket means attached to each of the legs and disposed parallel to the flat floor member and above the partitions.

2. The desk of claim 1 where at least one of the compartments includes an openable closure disposed proximate the front edge of the tray.

* * * * *